US009579885B2

(12) United States Patent
Anderson et al.

(10) Patent No.: US 9,579,885 B2
(45) Date of Patent: Feb. 28, 2017

(54) METHOD AND SYSTEM TO STORE DROP COUNTS

(71) Applicant: Hewlett-Packard Development Company, L.P., Houston, TX (US)

(72) Inventors: Daryl E. Anderson, Corvallis, OR (US); Andrew L. Van Brocklin, Corvallis, OR (US); James Michael Gardner, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/439,899

(22) PCT Filed: Oct. 31, 2012

(86) PCT No.: PCT/US2012/062748
§ 371 (c)(1),
(2) Date: Apr. 30, 2015

(87) PCT Pub. No.: WO2014/070161
PCT Pub. Date: May 8, 2014

(65) Prior Publication Data

US 2015/0290932 A1 Oct. 15, 2015

(51) Int. Cl.
*B41J 32/00* (2006.01)
*B41J 2/045* (2006.01)
*B41J 2/175* (2006.01)

(52) U.S. Cl.
CPC ..... *B41J 2/04535* (2013.01); *B41J 2/04586* (2013.01); *B41J 2/17546* (2013.01); *B41J 2002/17569* (2013.01)

(58) Field of Classification Search
CPC ..... B41J 2/04535
USPC ..... 347/5, 7, 9
See application file for complete search history.

(56) References Cited

U.S. PATENT DOCUMENTS

| | | | | |
|---|---|---|---|---|
| 5,365,312 | A * | 11/1994 | Hillmann | B41J 2/17546 101/336 |
| 5,610,635 | A | 3/1997 | Murray et al. | |
| 6,106,088 | A | 8/2000 | Wafler | |
| 6,286,923 | B1 | 9/2001 | Sugahara | |
| 2009/0021987 | A1 * | 1/2009 | Sarin | G11C 11/5642 365/185.21 |
| 2009/0244163 | A1 | 10/2009 | Govyadinov | |

FOREIGN PATENT DOCUMENTS

EP 0720916 A2 7/1996

OTHER PUBLICATIONS

PCT Search Report and Written Opinion for International Application No. PCT/US2012/062748, dated Apr. 25, 2013, 11 pgs.

* cited by examiner

*Primary Examiner* — Lam Nguyen
(74) *Attorney, Agent, or Firm* — HP Inc.—Patent Department

(57) ABSTRACT

An exemplary embodiment of the present technique may include a method including monitoring a number of drops of ink released by a print head of a printing device. The method may also include associating the number of drops of ink with a quanta of charge. The method may also include storing the associated quanta of charge in a memory cell of a programmable read-only memory (PROM) device.

12 Claims, 4 Drawing Sheets

400

400

METHOD AND SYSTEM TO STORE DROP COUNTS

TECHNICAL FIELD

The present technique relates generally to a method and system of storing drop counts of ink for a printing device. More specifically, the present technique relates to a method of improving resolution for storing drop counts of ink as a quanta of charge in a programmable read-only memory device.

BACKGROUND

Printing devices release ink through an ink cartridge of a print head. As ink is released a drop count is monitored, the drop count relating to the quantity of ink released from the ink cartridge. Monitoring of drop counts may enable a user of a printer or printing system to estimate the quantity of ink left in the ink cartridge. Some printers are configured to monitor the drop count by providing a charge to a memory cell of a programmable read-only memory device. Storage of charges in a memory cell has been limited to one bit per cell, requiring many cells for finer resolution of the drop count. When many cells cannot be added to the print head, drop count resolution is sacrificed.

BRIEF DESCRIPTION OF THE DRAWINGS

Certain exemplary embodiments are described in the following detailed description and in reference to the drawings, in which.

DETAILED DESCRIPTION OF SPECIFIC EMBODIMENTS

Printing devices may include ink cartridges configured to release ink as drops, which are used to form an image on a target surface. As ink drops are released, systems and methods described herein provide for receiving and storing data related to the quantity of drops released to the ink cartridge. The quantity of ink released may be referred to herein as a drop count.

Some storage systems use programmable read-only memory (PROM) devices which are configured to fill a memory cell of the PROM device for a predetermined quantity of drop counts. These systems use one PROM bit for each predetermined quantity of drop counts. For example, if the PROM device has 4 cells, each cell has 1 bit, and therefore only 4 predetermined quantities of drop counts are stored. Rather than using one PROM bit for each predetermined quantity of drop counts, the system and method described herein may store multiple quantities of charge for each predetermined quantity of drop counts in an analog fashion. By storing multiple quantities of charge in an analog fashion, each cell may be partially charged enabling an increased resolution of the drop count.

Figure 1:
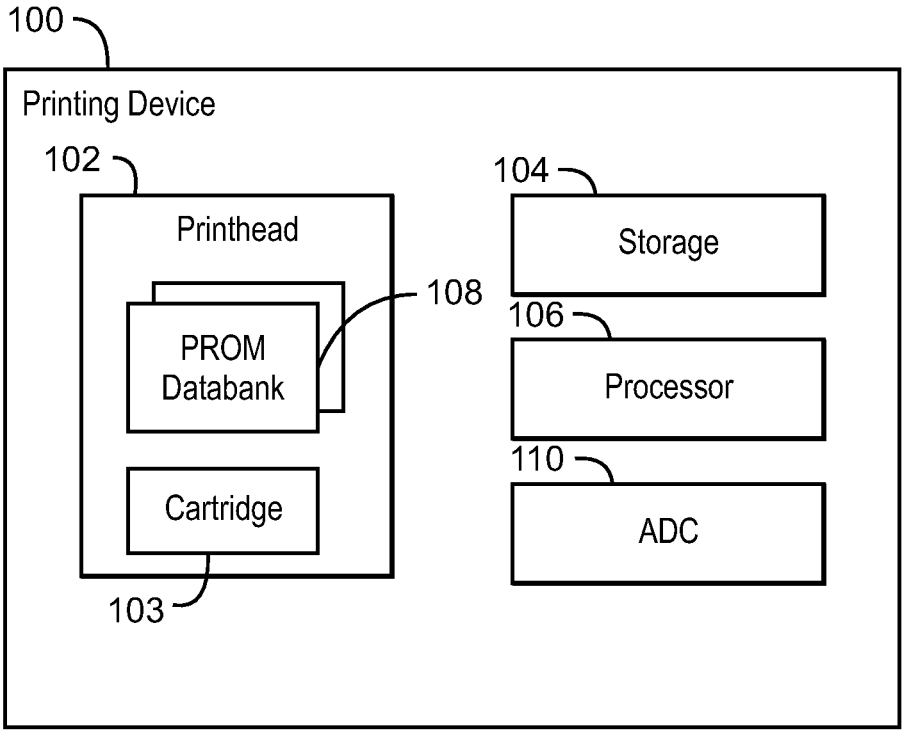
FIG. 1 is a block diagram of a printing device configured to store drop counts at a databank.

FIG. 1 is a block diagram of a printing device configured to store drop counts at a databank. The printing device 100 may be configured to enable a number of drops of ink released by a print head 102 of the printing device 100 to be determined. The printing device 100 may also include an ink cartridge 103 configured to release a number of drops of ink. The printing device 100 may also include a storage device 104, the storage device 104 that holds instructions for determining the ink drop counts. The printing device 100 may also include a processor 106 that executes the instructions stored in the storage device 104. The stored instructions may cause the processor 106 to monitor a number of drops of ink released by the print head 102. The stored instructions may also cause the processor 106 to associate the number of drops of ink with a quanta of charge. The stored instructions may also cause the processor 106 to store the associated quanta of charge in a memory cell of a programmable read-only memory (PROM) device, or PROM databank 108.

The processor 106 can be a single core processor, a multi-core processor, a computing cluster, or any number of other configurations. The processor 106 may be implemented as Complex Instruction Set Computer (CISC) or Reduced Instruction Set Computer (RISC) processors, x86 Instruction set compatible processors, multi-core, or any other microprocessor or central processing unit (CPU). In some embodiments, the processor 106 includes dual-core processor(s), dual-core mobile processor(s), field programmable gate array(s), microcontroller(s), or the like.

In embodiments, the printing device 100 may not include the processor 106 or the storage device 104. In these embodiments, the printing device 100 includes internal circuitry configured to generate a charge as a predetermined number of drops of ink have been released by the cartridge 103. The printing device 100 may be configured to receive a quanta of charge related to the number of drops of ink released by the cartridge 103 and provide the quanta of charge to a memory cell of the PROM databank 108 to be stored in the memory cell. The circuitry may include a gate configured to provide the quanta of charge to the PROM databank 108 by gating a current charge with a predetermined number of clock counts. The predetermined number of clock counts may be based on an association of the resulting current charge with a predetermined number of drops of ink. In an embodiment, the circuitry is configured to receive a charge for every drop of ink released by the cartridge 103. A gate may release the current charge after a quanta of charge associated with the predetermined number of drops of ink is met. The PROM databank 108 may receive the charge from the gate and store the charge in an active memory cell of the PROM databank 108. By excluding the storage device 104 and processor 106, the print head 102 of the printing device 100 may thereby be more cost effective to produce.

In some embodiments, the storage device 104 and the processor 106 are included in the printing device 100, and the stored instructions may be configured to be carried out by the processor 106. The stored instructions may also cause the processor 106 to compare the stored quanta of charge to a value associated with a predetermined number of drops of ink to determine the number of drops of ink released by the print head 102. The value may be an analog value associated with the predetermined number of drops of ink. For example, the stored quanta of charge may be 1 ampere-hour (Ah) and the value may be associated with a drop count of 10,000. The processor 106 may read the quanta of charge of 1 Ah and associate it with the drop count of 10,000.

In embodiments, the printing device 100 may further include an analog to digital conversion (ADC) device 110. The ADC 110 may be configured to convert the stored quanta of charge to a digital signal. The digital signal may be compared to a predetermined digital value.

In embodiments, the printing device 100 may include more than one databank 108. For example, the printing device 100 may include a databank configured to store the quanta of charge in a memory cell and a reference databank configured to store a similar quanta of charge in a respective memory cell. A reference databank may enable the processor 106 to compare values in the each databank to verify levels of charge decay, as is further explained below in reference to FIG. 3.

Figure 2:
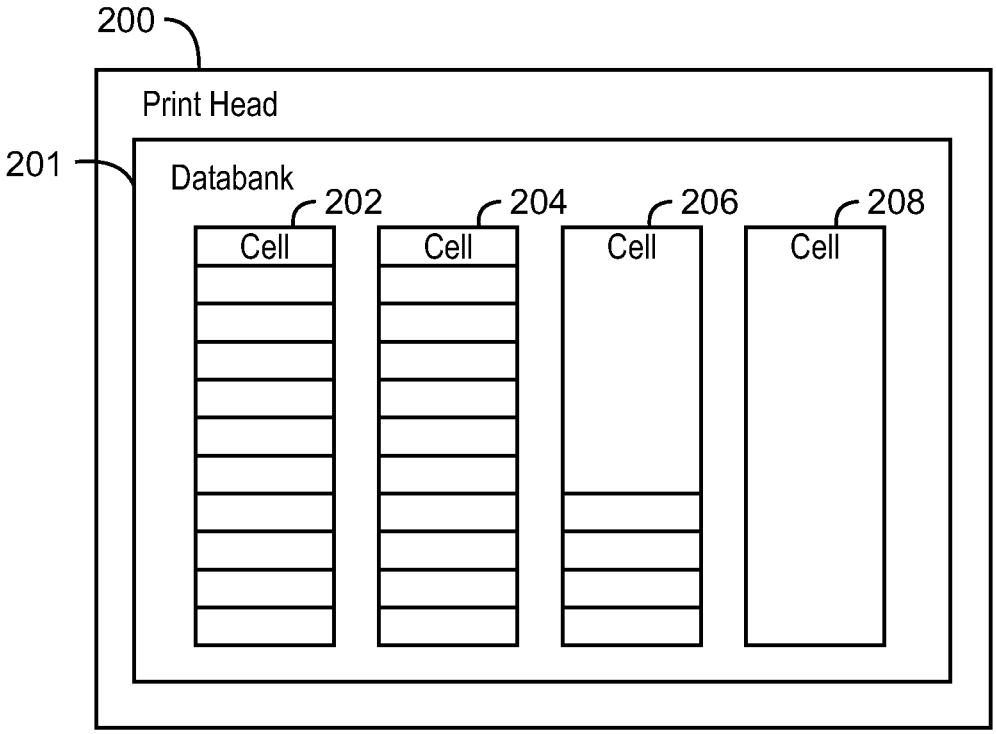
FIG. 2 is a block diagram of a databank of a print head at which charges related to drop counts are stored.

FIG. 2 is a block diagram of a print head 200 having a databank 201 in which charges related to drop counts are stored. The databank 201 is a PROM device as discussed in reference to the PROM databank 108 above. The databank 201 may also be a separate component from the print head 200. The databank 201 may include a number of memory cells, for example, including memory cells 202, 204, 206, and 208, where each memory cell may be configured to store a quanta of charge. Each of the memory cells 202, 204, 206, and 208 may be capable of storing more than one quanta of charge. For example, memory cell 206 may include 4 quantum of charge as indicated in FIG. 2. The PROM databank 201 may receive the quanta of charge from the print head. The quanta of charge may be related to the number of drops of ink released by an ink cartridge of the print head 200. The quanta of charge may be provided to the PROM databank 201 from circuitry of the print head 200.

In embodiments, the print head 200 may be communicatively coupled to a processor (not shown) configured to read the quantum of charge stored in the PROM databank 201 and compare the quantum of charge to a predefined set value related to a drop count of ink released by a cartridge of the print head 200. The processor may be configured to read every charged memory cell and aggregate the charges to compare a total charge with the predetermined values associated with the drop count. For example, the PROM databank 108 may have 4 memory cells 202, 204, 206, and 208 including 2 fully charged memory cells 202 and 204, 1 partially charged memory cell 206, and 1 non-charged memory cell 208. The partially charged memory cell 206 may be an active cell. The processor may read the fully charged memory cells 202 and 204 to have 10 Ah each. The processor may also read the partially charged active cell 206 to have 4 Ah. The processor may aggregate the total charge to equal 24 Ah. The processor 106 may then compare the total charge of 24 Ah with the predetermined drop count value of 10,000 per every 1 Ah, and determine the total drop count to be 240,000.

In an embodiment, the value is an analog value such as 1 Ah. In other embodiments, the predetermined value is digital value where the PROM device 200 is communicatively coupled to an analog to digital conversion (ADC) device. The ADC is discussed on more detail below in reference to FIG. 3.

Figure 3:
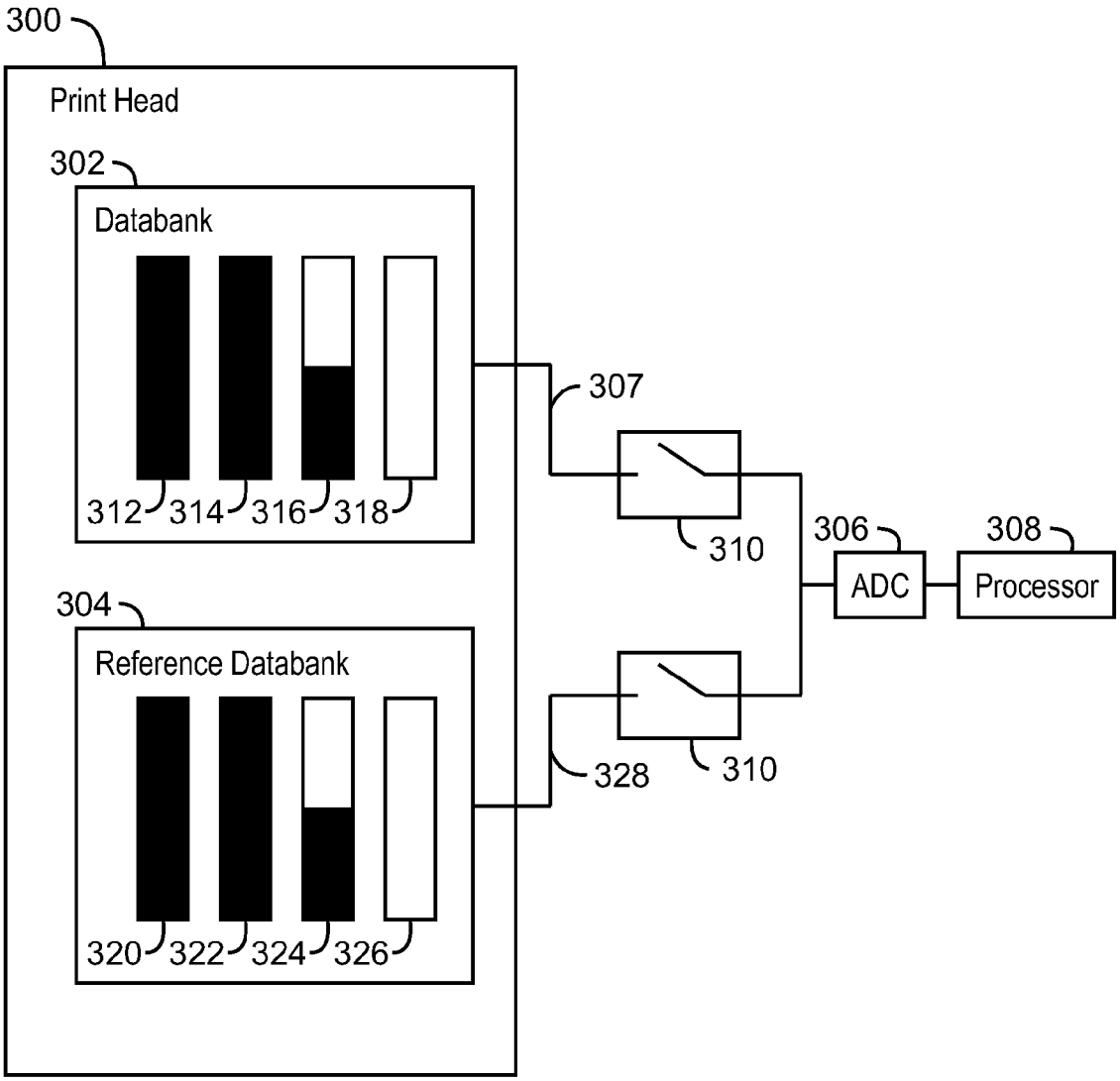
FIG. 3 is block diagram of a print head including a databank and a reference bank communicatively coupled to an analog to digital conversion device.

FIG. 3 is a block diagram of a print head 300 including a databank 302 and a reference bank 304 communicatively coupled to an ADC 306. The databank 302 may be a PROM device similar to the PROM device 108 and 200 discussed in reference to FIGS. 1 and 2 above. The print head 300 may include a communication interface 307 between the PROM device 302 and the ADC 306 to convert the stored quanta of charge to a digital signal, when the predetermined value is a digital value. The print head 300 may be communicatively coupled to a processor 308 via a gate 310 and the ADC 306. The processor 308 may be configured to receive the digital signal from the ADC 306 and compare the digital signal to a predetermined set digital value associated with a drop count.

In embodiments, the quanta of charge in the memory cell of the PROM databank 302 may decay over time. The PROM databank 302 may include a number of memory cells, for example, memory cells 312, 314, 316, and 318, wherein memory cell 316 is partially charged. The decay rate of the partially charged memory cell 316 may be different from the decay rate of a fully charged memory cell such as memory cells 312, 214. Therefore, a reference databank 304 may be included. The reference databank 304 is a PROM device similar to the databank 302. The reference databank 304 may have a number of reference memory cells 320, 322, 324, and 326 configured to store various levels of charge that may decay over time. The reference databank 304 is configured to enable the decay rate of memory cells 312, 314, 316, and 318 may be compared to the reference memory cells 320, 322, 324, and 326.

For example, the fully charged memory cells 312, 314 may be compared against the fully charged reference memory cell 320 to verify the amount of decay that may have occurred over time. Likewise, the partially charged memory cell 316 may be compared to the partially charged reference memory cell 324. The reference databank 304 may be communicatively coupled to the processor 308 via a communication interface 328 between the reference databank 304 and the ADC 306. The ADC 306 may receive a stored quanta of charge related to the charge stored in one or more of the reference memory cells 320, 322, 324, and 326, and may convert the stored quanta of charge to a digital signal, when the predetermined value is a digital value. The processor 308 may be configured to compare the digital signal associated with the reference databank 304 with the digital signal from the databank 302 to verify the decay over time of the memory cells 312, 314, 316, and 318.

Figure 4:
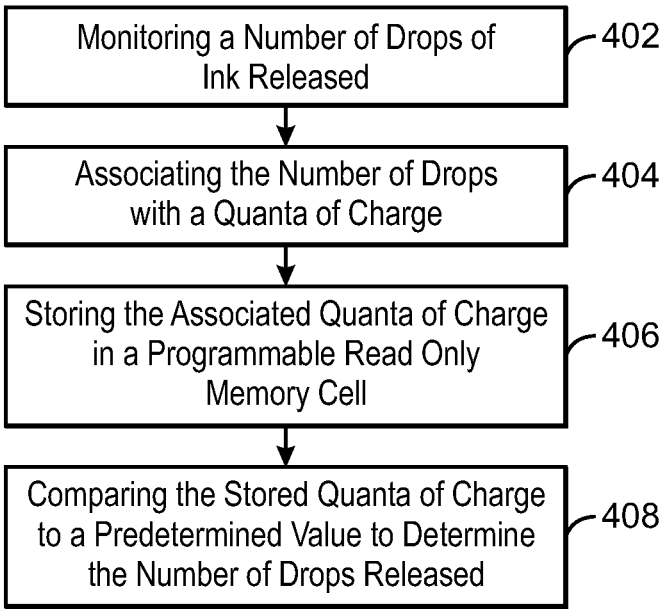
FIG. 4 is block diagram of a method to enable charges related to drop counts to be stored at a databank.

FIG. 4 is block diagram of a method 400 to enable charges related to drop counts to be stored at a databank. The method 400 may include monitoring 402 a number of drops of ink released by a print head of a printing device. The number of drops may also be released by a cartridge that may be remote from the print head.

The method 400 may also include associating 404 the number of drops of ink with a quanta of charge. The method 400 may implement association 404 via circuitry of the printing device configured to release the quanta of charge as a number of drops of ink have been released. For example, for every 10,000 drops of ink a quanta of charge, 1 Ah for example, may be associated and released from the circuitry of the printing device.

The method 400 may also include storing 406 the associated quanta of charge in a memory cell of a programmable read-only memory (PROM) device. The memory cell may be configured to enable a partial charge to be stored. In an embodiment, the quanta of charge are stored in the memory cell by gating a charging current with a predetermined number of clock counts. The PROM device may be configured to store quanta of charge and provide the quanta of charge to a processing device to compare the stored charge with a number of drops of ink released by the cartridge.

Thus, the method 400 may also include comparing 408 the stored quanta of charge to a predetermined value to determine the number of drops released. The comparison may be carried out by a processing device. In embodiments, the stored quanta of charge may be compared to a predetermined analog value.

Additionally or alternatively, the stored quanta of charge may be compared to a digital value. For example, the stored quanta of charge may be provided to an ADC configured to convert the stored quanta of charge to a digital signal. The digital signal can then be compared to a predetermined digital value associated with a number of drops of ink.

In embodiments, the method 400 may include additional steps not shown in FIG. 4. For example, in embodiments, the quanta of charge in the memory cell decays over time. Therefore, the method 400 may also include comparing the memory cell to a reference cell of a reference PROM device to determine the rate of decay of the memory cell. The method 400 may also include verifying the quanta of charge of the memory cell based on the comparison to the reference cell.

Examples of a printing device may include a peripheral device to a computing device configured to produce a representation of an electronic document on physical media such as paper or film. The printing device may include a local device physically connected to a computing device, or a network printer having a built-in network interface that can server any user of the network. The printing device may also be configured to print documents stored on memory cards or from digital cameras or scanners. The printing device may also include a device with additional functions such as copying, faxing, or scanning.

Examples of an ink cartridge may include a thermal inkjet cartridge, piezoelectric ink cartridge, or any component of a printing device configured to release ink or toner onto some physical media such as paper or film. The ink cartridge may also include an electronic chip configured to communicate with the printing device.

What has been described and illustrated herein is a preferred embodiment of the invention along with some of its variations. The terms, descriptions and figures used herein are set from by way of illustration only and are not meant as limitations. Those skilled in the art will recognize that many variations are possible within the scope of the invention, which is intended to be defined by the following claims—and there equivalents—in which all terms are meant in their broadest reasonable sense unless otherwise indicated.

What is claimed is:

1. A method, comprising:

monitoring a number of drops of ink released by a print head of a printing device;

associating the number of drops of ink with a quanta of charge;

storing the associated quanta of charge in a memory cell of a programmable read-only memory (PROM) device; and comparing the stored quanta of charge to a value associated with a predetermined number of drops of ink to determine the number of drops of ink released by the print head.

2. The method of claim 1, further comprising converting the stored quanta of charge to a digital signal at an analog to digital conversion (ADC) device, wherein the value is a digital value.

3. The method of claim 1, wherein the quanta of charge in the memory cell decays over time, further comprising:

comparing the memory cell to a reference cell of a reference PROM device to determine the rate of decay of the memory cell; and verifying the quanta of charge of the memory cell based on the comparison to the reference cell.

4. A system, comprising:

a printing device to enable a number of drops of ink released by a print head of the printing device to be determined;

a storage device, the storage device to store instructions for determining the ink drop counts; and a processor of the printing device that executes the stored instructions to:

monitor a number of drops of ink released by the print head;

associate the number of drops of ink with a quanta of charge;

store the associated quanta of charge in a memory cell of a programmable read-only memory (PROM) device; and compare the stored quanta of charge to a value associated with a predetermined number of drops of ink to determine the number of drops of ink released by the print head.

5. The system of claim 4, further comprising an analog to digital conversion (ADC) device to convert the stored quanta of charge to a digital signal, wherein the value is a digital value.

6. The system of claim 4, wherein the quanta of charge in the memory cell decays over time, further comprising a reference cell in a reference PROM device, wherein the reference cell has a similar charge as the memory cell.

7. The system of claim 6, wherein the processor further executes the stored instructions to:

compare the memory cell to the reference cell to determine the rate of decay of the memory cell; and verifies the quanta of charge of the memory cell based on the comparison to the reference cell.

8. A print head of printing device, comprising:

an ink cartridge configured to release a number of drops of ink; and a memory cell of a programmable read-only memory (PROM) device to store the quanta of charge; where the memory cell is capable of storing more than one quanta of charge;

wherein the print head is to receive a quanta of charge related to the number of drops of ink released, and is to provide the quanta of charge to the memory cell of the PROM device to be stored in the memory cell; and wherein the print head is to provide the stored quanta of charge to a processing device to compare the stored quanta of charge to a value associated with a predetermined number of drops of ink to determine the number of drops of ink released by the print head.

9. The print head of claim 8, further comprising a communication interface between the PROM device and an analog to digital conversion (ADC) device to convert the stored quanta of charge to a digital signal, wherein the value is a digital value.

10. The print head of claim 8, wherein the associated quanta of charge is stored in the memory cell by gating a charging current with a predetermined number of clock counts.

11. The print head of claim 8, wherein the quanta of charge in the memory cell decays over time, further comprising a reference cell in a reference PROM device, wherein the reference cell has a similar charge as the memory cell.

12. The print head of claim 11, wherein the printhead is coupled to a storage device, the storage device to store instructions for determining the ink drop counts; and a processor that executes the stored instructions to:

compare the memory cell to the reference cell to determine the rate of decay of the memory cell; and verify the quanta of charge of the memory cell based on the comparison to the reference cell.

* * * * *